US006901822B2

(12) United States Patent
Boys

(10) Patent No.: US 6,901,822 B2
(45) Date of Patent: Jun. 7, 2005

(54) METHOD AND APPARATUS FOR JOINING A HANDLE TO A HAMMER HEAD

(75) Inventor: Mark A. Boys, Aromas, CA (US)

(73) Assignee: Soundstarts, Inc., Aromas, CA (US)

( * ) Notice: Subject to any disclaimer, the term of this patent is extended or adjusted under 35 U.S.C. 154(b) by 26 days.

(21) Appl. No.: 10/630,606

(22) Filed: Jul. 29, 2003

(65) Prior Publication Data

US 2005/0022630 A1 Feb. 3, 2005

(51) Int. Cl.[7] ..... B25D 1/00
(52) U.S. Cl. ..... 81/20; 30/308.1; 403/290; 403/314
(58) Field of Search ..... 81/20; 30/308.1; 403/289, 290, 313, 314

(56) References Cited

U.S. PATENT DOCUMENTS 3,355,226 A * 11/1967 Portz ..... 403/268
4,139,930 A * 2/1979 Cox ..... 30/308.1
5,546,832 A * 8/1996 Townsend ..... 81/20
5,896,788 A * 4/1999 Hreha et al. ..... 81/20
6,494,119 B1 * 12/2002 Coonrad ..... 81/20

* cited by examiner

*Primary Examiner*—James G. Smith
(74) *Attorney, Agent, or Firm*—Donald R. Boys; Central Coast Patent Agency, Inc.

(57) ABSTRACT

A striking tool comprising a head assembled to a handle having a long axis is characterized in that the head comprises a closed cavity extending into the head in the direction of the long axis, an opening through a wall of the head into the cavity, the opening extending at substantially a right angle to the long axis, and a spreading element inserted through the opening and spreading a portion of the handle within the cavity to urge against walls of the cavity to secure the head to the handle.

7 Claims, 4 Drawing Sheets

METHOD AND APPARATUS FOR JOINING A HANDLE TO A HAMMER HEAD

FIELD OF THE INVENTION

Figure 1B:
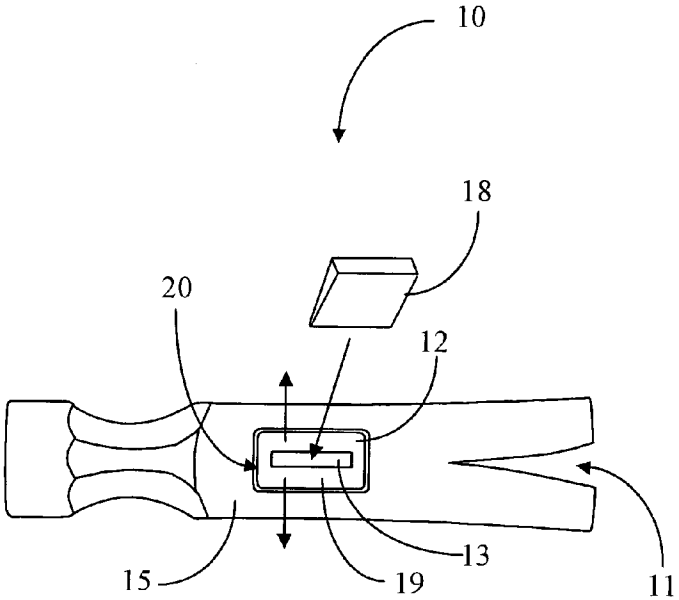
Fig. 1b (Prior Art)

The present invention is in the field of hand-held striking tools, such as hammers, and pertains more particularly to hammer-head to handle interfaces for such tools, accommodating a demand for improving the interface and claw hammer versatility.

BACKGROUND OF THE INVENTION

Handheld striking tools such as various types of hammers, pickaxes and the like have been used by people in a variety of disciplines over many generations as leveraged devices for providing a striking force to accomplish a seemingly endless variety of tasks. For example, a claw hammer, commonly weighing from 7 to 32 ounces is used for performing carpentry work wherein a striking force sufficient for driving a nail into wood is often required, as is the need for removing nails from wood or ripping apart lumber using the claw portion of the hammer.

Handheld striking tools, such as the conventional claw hammer described above, are most commonly used as third-class levers for providing a striking force to accomplish tasks such as driving a nail into wood, shaping or forming various bendable or malleable materials, and a variety of similar uses. Third-class levers are levers wherein the fulcrum, or pivot point is located at one end of a bar or rod, and in the case of a hand-held striking tool such as a claw hammer, the fulcrum is the users wrist, wherein by the user grasping the rod or bar by a handle at one end and swinging the rod or bar with a striking head attached to the rod or bar at the opposite end of a handle end, striking force is provided by the sudden deceleration of the movement of the hammer handle at the user's wrist, and the load is the resistance presented by, for example, a portion of wood into which a nail is being driven by the hammer head portion striking the nail.

The head portion of a hand-held striking device such as the conventional claw hammer described above, is typically a significant distance from the fulcrum, in this case the user's wrist, and during swinging of the striking tool, the head portion moves much faster than the movement being applied at the user's wrist, and the increased speed of the head portion greatly multiplies the applied force with which a striking device head strikes a nail, for example. The longer the claw hammer's handle portion is, for example, the faster the head travels during swinging of the striking tool, and thus, the greater the force of the head origin striking the nail, overcoming the load, or resistance of the wood into which the nail is driven.

Handheld striking tools, such as claw hammers, are also commonly used as first-class levers to provide a lifting or prying force to accomplish a variety of tasks, which commonly include removing nails previously driven into wood, for example, or ripping apart pieces of wood or other such building material, and so on. Such first-class levers wherein the load to be overcome is at or near one end of a rod or bar, the effort, or force is applied at or near the opposite end of the same rod or bar, and the fulcrum, or pivot, is located somewhere along the rod or bar in between the applied force and the load at opposite ends of the rod or bar.

A common example of a hand-held striking tool being used as a first-class lever is a claw hammer being used to remove nails previously driven into wood or other building material, wherein the load to be overcome is the wood causing friction against an embedded nail. When such a hand-held striking tool is used as a first-class lever, such as a conventional claw hammer as described above, the force is applied at one end of a handle of substantial length, the fulcrum typically being near the opposite end of the handle which holds the head portion, or striking portion of the hand-held striking tool.

Figure 1A:
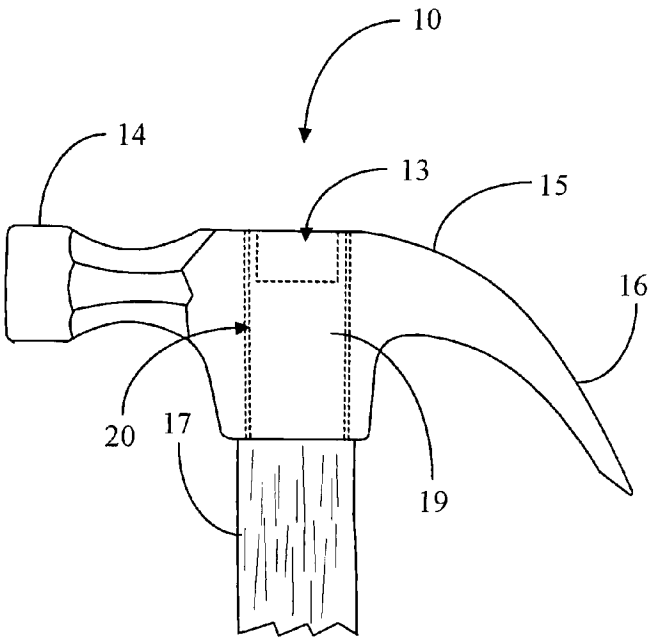
Fig. 1a (Prior Art)

In a conventional claw hammer, for example, the head portion is attached at one end of a bar or rod, and a handle portion is at the opposite end of the bar or rod. FIGS. 1*a* and 1*b* of the present application exemplifies such a prior art conventional hand-held striking tool, the versatility upon which the present invention provides substantial improvement. The head portion of a conventional claw hammer as shown in FIGS. 1 and 2 comprises an interface for attaching the hammer head to the hammer handle, utilizing an opening extending through the hammer head which accommodates insertion of the interface portion of the handle. This opening is known as the eye in the art. An impact head or striking portion extends a substantial distance from the center interface portion of the hammer head in one direction, and the curved claw end, typically used for removing nails or ripping apart building material, for example, extends a substantially equal distance from the center interface portion of the hammer head in the opposite direction.

However, one certain drawback in conventional claw hammers such as shown in the prior art example of FIG. 1, is that the versatility of the claw hammer is substantially compromised in that, if the user wishes to remove a nail from material into which it has been previously driven, and the driven nail is located close to a protruding object, such as a wall stud or other such obstruction, such that the distance between the nail to be removed and the obstacle is less than the distance between the center of the interface portion of the hammer head and the portion in the slot of the claw portion appropriate for gripping around the nails circumference under the head of the nail, the user will often not be able to use the claw hammer for removing the nail, and must rely on another separate nail-pulling tool in order to remove the nail from the material in such a tight space. The user's cost, maintenance and effort required for providing such work thereby increases. It is therefore desirable for the user to be able to remove nails from such tight spaces utilizing a single, more versatile claw hammer suitable for such purposes, which also serves to remove nails in the conventional manner with the claw end while also providing the striking force for driving nails, and the ability to easily and conveniently rip apart wood or other such building materials, as described above.

Another drawback in such conventional claw hammers is that while pulling nails in a conventional manner utilizing the claw end of the head portion of the claw hammer, the interface portion of the hammer head, which is typically secured with one or a plurality of retaining wedges driven down into the interface portion of the handle, may cause damage to the material upon which the upper surface of the hammer head portion makes contact during the action of pulling the nail. If the upper portion of the hammer head-to-handle interface is not relatively flush with the upper surface of the hammer head, or the retaining wedge(s) driven into the interface portion from above are either driven below the upper surface of the interface portion, or are protruding out of the interface portion above the level of the upper surface of a hammer head making contact with the material when pulling the nail, the surface of the hammer head which rocks along the material from which the nail is being pulled is not a smooth surface, and thereby may cause unwanted damage to the material. It is therefore desirable for the top surface of the hammer head to be as smooth as possible in order to avoid such possible damage, which is difficult to accomplish utilizing the head to handle interface as described for the prior art example presented of a conventional claw hammer.

As is well-known in the art, the weakest juncture of a hand-held striking device such as the conventional claw hammer described herein is the striking head to hammer handle interface. As described above, a conventional method of interfacing a hammer head and handle allows striking and pulling stresses, which are substantially concentrated at the head portion of the striking tool, to promote loosening, damage and separation of the interface, or loosening or separation of the retaining wedges driven into the upper portion of a handle interface for securing the interface. If, at any time during operation of the striking tool, one or any of the retaining wedges utilized becomes loose or separates from its embedded position in the hammer handle interface, injury to the user or persons near, and/or damage to the materials is a very likely result. It is therefore also desirable for the securing portion of the head to handle interface, specifically the point along the interface portion of the handle into which retaining wedges or other securing apparatus apply their securing force, to be located further down along the handle from the upper head portion, as is the typical securing manner for a conventional claw hammer as described above, such that the retaining wedges or other securing apparatus, and their securing point, is much less susceptible to the substantial striking and pulling stresses which are typically concentrated at a head portion of the striking tool during striking or pulling a nail, for example.

The conventional types of head to handle interfaces and methods for securing such interfaces as described above are commonly used with many different types of hand-held striking tools, other than claw hammers. For example, sledge hammers, axes, and so on, commonly use such interfaces and methods for securing, and the conventional solutions therefore still present the problem of the striking and pulling forces been concentrated over a very short distance at the interface located at the upper portion of the head portion of the striking tool. The intensified stress at this small area is cause of the majority of hand-held striking tool failures, where the structural integrity of the head to handle interface is compromised. Such conventional head to handle interfaces according to conventional art often fail because of such concentrated stresses at the head portion of the striking tool.

What is clearly needed is and improved method and apparatus for securing the head of a striking tool to its handle which provides both a durable and secure interface which is substantially less susceptible to the extreme striking and pulling forces. The striking tool utilizing such an improved head to handle interface securing method and apparatus, has a securing portion of the interface which extends along a greater portion of the interface as compared to conventional interfaces described above, and is also located further down the handle interface portion from the upper head portion of the striking tool. By relocating the interface securing point from the upper-most portion of the handle interface, to a point lower along the handle interface, the manufacturer is able to design a completely smooth upper surface of the head portion of the striking tool, such that when using the striking tool for removing nails in the conventional or non-conventional manner as will be disclosed, the possibility of damage being caused to the material along which the top surface of the head portion rocks during pulling of a nail, is substantially minimized.

What is also clearly needed is to enable the user, utilizing a single hand-held striking tool such as a claw hammer, to not only provide the striking force for driving nails and an improved ability for ripping apart materials, and conventional capability for removing nails utilizing an extended claw end, but also the ability to remove nails from wood or other building materials wherein the nail to be removed is adjacent to, or closely located to an obstruction such as a wall stud, for example. Such non-conventional nail pulling capability is enabled by a smooth upper surface of the head portion by virtue of relocating the handle to head interface securing point lower along the interface portion, and the non-conventional location of a nail pulling apparatus along the upper smooth surface of the head portion. Such an improved method and apparatus is herein provided below in enabling detail.

SUMMARY OF THE INVENTION

A striking tool comprising a head assembled to a handle having a long axis is provided, characterized in that the head comprises a closed cavity extending into the head in the direction of the long axis, an opening through a wall of the head into the cavity, the opening extending at substantially a right angle to the long axis, and a spreading element inserted through the opening and spreading a portion of the handle within the cavity to urge against walls of the cavity to secure the head to the handle.

In some preferred embodiments the striking tool has a plane of substantial symmetry, and the opening for the spreading element extends in a direction substantially at a right angle to the long axis and substantially at a right angle to the plane of substantial symmetry. In other preferred embodiments the striking tool has an axis of substantial symmetry, and the opening for the spreading element extends in a direction substantially at a right angle to the long axis and in the plane of substantial symmetry.

In some cases the spreading element comprises a tapered wedge. Also in some embodiments the portion of the handle extending into the cavity in the head comprises a slot positioned to receive the spreading element, such that the spreading element enters the slot urging parts of the handle on opposite sides of the slot apart and against the walls of the cavity.

In some other embodiments the spreading element comprises a rotatable cam, and in this case in some embodiments the portion of the handle extending into the cavity in the head comprises a slot and a cam opening to receive the rotatable cam, the cam opening positioned to receive the cam, such that as the rotatable cam is rotated the parts of the handle on opposite sides of the slot are urged apart and against the walls of the cavity.

In another aspect of the invention a method for affixing a head to a handle having a long axis to form a striking tool is provided, comprising the steps of (a) providing a closed cavity extending into the head in the direction of the long axis and an opening through a wall of the head into the cavity, the opening extending at substantially a right angle to the long axis; and (b) inserting a spreading element through the opening to spread a portion of the handle within the cavity to urge against walls of the cavity to secure the head to the handle.

In some preferred embodiments of the invention the assembled striking tool has a plane of substantial symmetry, and the opening for the spreading element extends in a direction substantially at a right angle to the long axis and substantially at a right angle to the plane of substantial symmetry. In some other embodiments the assembled striking tool has a plane of substantial symmetry, and the opening for the spreading element extends in a direction substantially at a right angle to the long axis and in the plane of substantial symmetry.

In some cases spreading element comprises a tapered wedge, and in some cases the portion of the handle extending into the cavity in the head comprises a slot positioned to receive the spreading element, such that the spreading element enters the slot urging parts of the handle on opposite sides of the slot apart and against the walls of the cavity.

In yet other cases the spreading element comprises a rotatable cam. In these cases the portion of the handle extending into the cavity in the head may comprise a slot and a cam opening to receive the rotatable cam, the cam opening positioned to receive the cam, such that as the rotatable cam is be rotated parts of the handle on opposite sides of the slot are urged apart and against the walls of the cavity.

BRIEF DESCRIPTION OF THE DRAWING FIGURES

FIG. 1*a* is a left side view of the head of a conventional claw hammer, head to handle interface and portion of hammer handle.

FIG. 1*b* is a top view of the conventional claw hammer and interface of FIG. 1*a*.

Figure 2B:
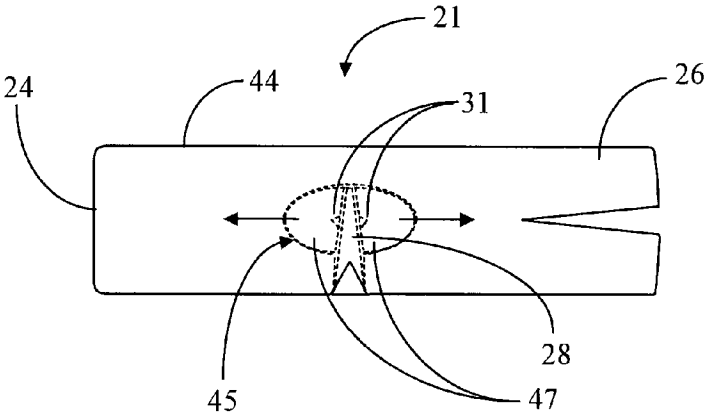
Figure 2A:
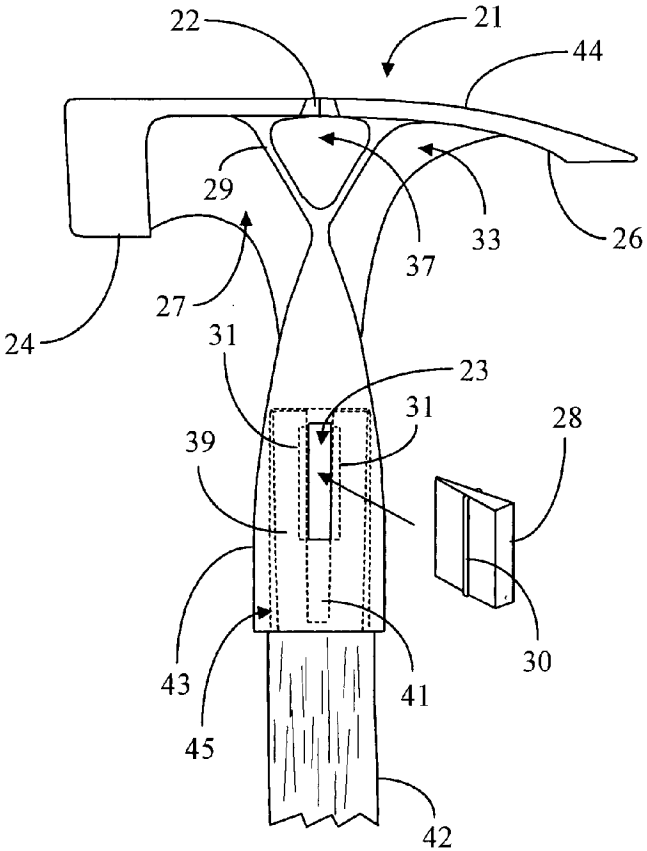

FIG. 2*a* is a left side broken view of a claw hammer, head to handle interface and portion of hammer handle according to an embodiment of the present invention.

FIG. 2*b* is a top view of the hammer head and head to handle interface of FIG. 2*a*.

Figure 3B:
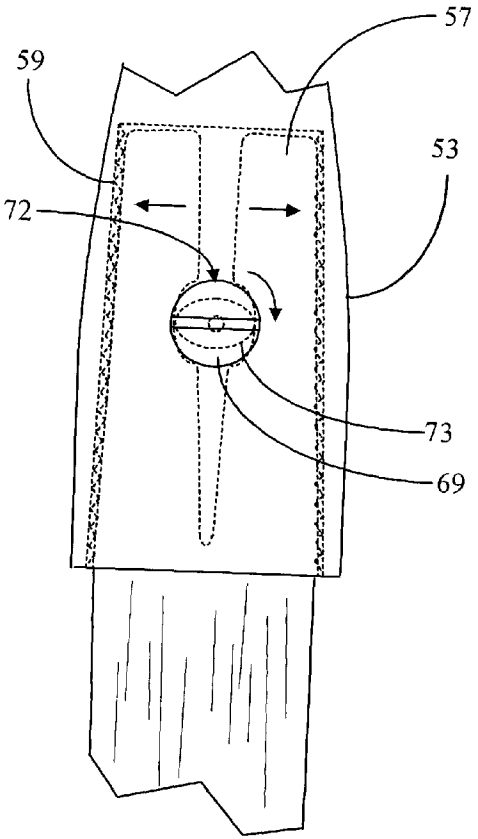
Figure 3A:
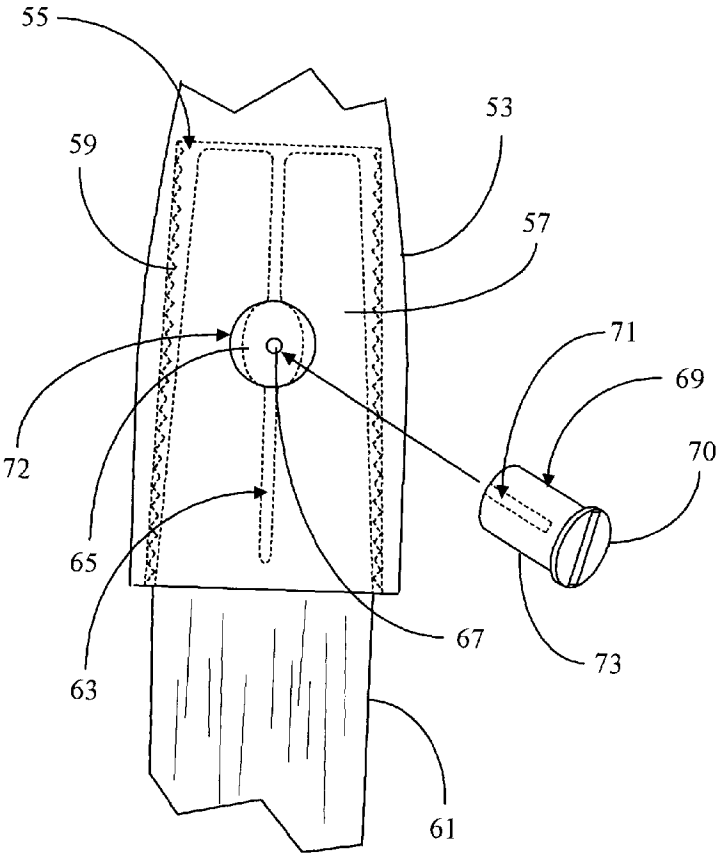

FIG. 3*a* is a broken elevation view of a hammer head to handle interface in the unsecured position and a portion of hammer handle according to an alternative embodiment of the present invention.

FIG. 3*b* is a broken elevation view of the hammer head to handle interface and handle portion of FIG. 3*a*, illustrated in the secured position.

Figure 4B:
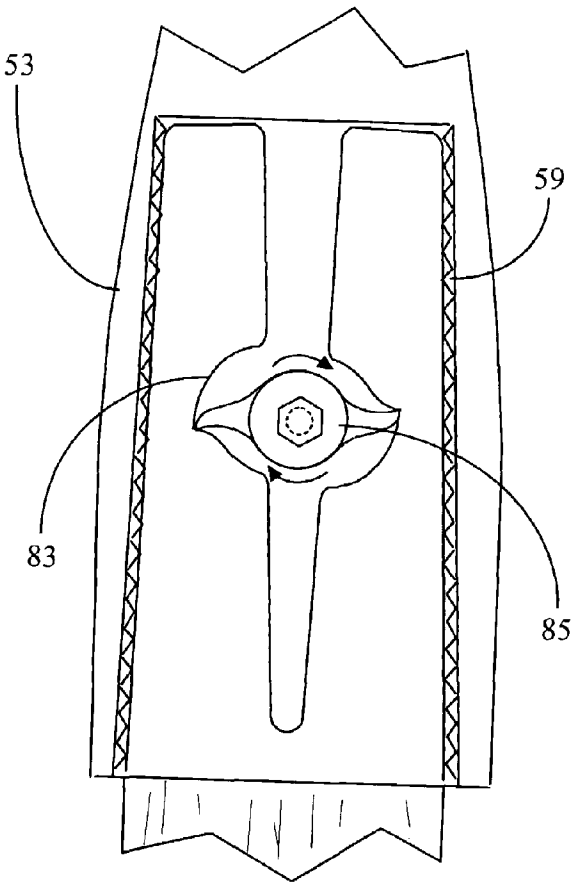
Figure 4A:
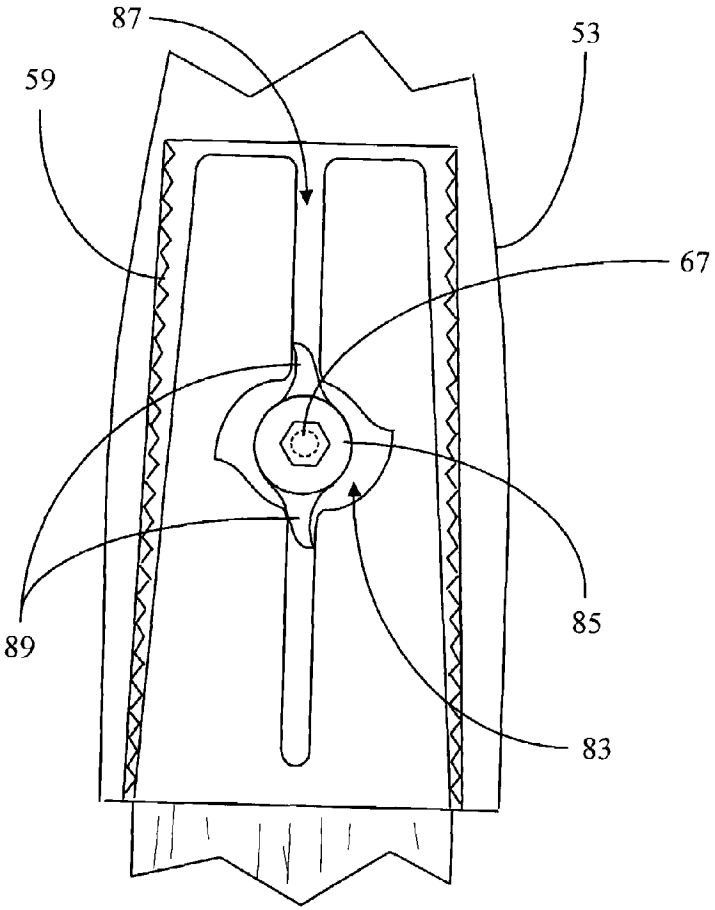

FIG. 4*a* is a broken elevation view of a hammer head to handle interface and handle portion according to an alternative embodiment of the present invention.

FIG. 4*b* is a broken elevation view of the hammer head to handle interface and handle portion of FIG. 4*a*.

DESCRIPTION OF THE PREFERRED EMBODIMENTS

The present invention overcomes many of the problems and deficiencies described above in conventional claw hammers providing a more durable and secure head to handle interface, and providing a head to handle interface securing point which is located farther away from the concentrated striking forces and pulling stresses at the head portion of the striking tool, as in a conventional claw hammer. The feature also accommodates a user's varying nail pulling and material ripping needs by allowing for a smooth upper surface of the hammer head which minimizes material damage while nail pulling or material ripping, and which also now accommodates a side pulling nail removal apparatus, for use when pulling nails adjacent to, or located near objects or protrusions, which would normally be difficult or impossible to remove utilizing a conventional claw hammer and conventional head to handle interface. The feature of relocating the securing point of the head to handle interface from the upper most portion of the handle interface, and improving the security and integrity of the interface, and providing a non-conventional side pulling nail removing apparatus accommodates the user's varying needs without requiring purchase and maintenance of two or more separate tools to provide such work. The present invention in various embodiments also provides a type of claw hammer that is well-suited for both pulling nails and ripping boards and other materials, further obviating the need for a user to purchase and maintain multiple types of hammers or nail pullers.

FIGS. 1*a* and 1*b* are side and top views of a conventional claw hammer, illustrating elements that are typical for hand-held striking devices, as well as parts common to a conventional claw hammer. Referring to FIG. 1*a*, claw hammer 10 comprises a hammer head 15 having an impact head 14 comprising the striking surface, and head to handle interface 19 which are elements commonly found in typical striking tools such as the conventional claw hammer shown, as well as other types of hand-held striking tools such as pickaxes, sledge hammers, and other such striking tools.

Elements common to conventional claw hammers such as claw hammer 10 illustrated are a conventional claw end 16 having a curving wedge shape and a conventional nail pulling slot 11, as shown in FIG. 1*b*. Conventional claw end 16 is either substantially curved or only slightly curved depending on its primary use as a nail pulling claw or a claw for ripping apart wood or other building materials. As is true for either case in conventional claw hammers, the wedge-shaped claw end 16 usually has a nail pulling slot such as slot 11, and the height of nail pulling slot 11 substantially conforms to wedge thickness along its length.

The characteristics of the claw, however, limit the ability of the user to grip and pull nails whose nail heads are driven close to the surface of material into which the nail is driven, and further, the conventional location for claw end 16 of hammer head 15, opposite impact head 14, also limits the user to only being able to pull nails which are located a sufficient distance away from any obstructions protruding up from the material into which the nail is driven, such as wall studs, cross members, and so on. In order to pull a nail located adjacent to such an obstruction, the distance between the nail and the obstruction must be greater than the distance between the outer tip of claw end 16, and the point in wedge 11 at which substantial contact is made between the inner surface of wedge 11 and the shaft of the nail to be pulled. If said distance between the nail to be pulled and the protruding obstruction is less than such distance, the user may have difficulty in removing the nail due to the length of claw end 16 and the resulting lack of versatility for claw hammer 10.

Head to handle interface 19 is a machined portion of handle 17 adapted to insert up through interface opening 20 (eye) of hammer head 15, interface opening 20 extending completely through the vertical thickness of hammer head 15. As is typical in a conventional interface such as illustrated, interface opening 20 has a bottom opening dimension substantially equal to the outer dimension of the uppermost portion of interface 19, and the opening tapers somewhat outward as it extends towards the top of hammer head 15, providing a top opening somewhat greater in dimension than the uppermost portion of interface 19. Head to handle interface 19 has substantially equal outer dimensions at both the bottom opening and top opening of interface opening 20.

As is common with conventional claw hammers a slot 13 may be machined into the upper portion of interface 19 for the purpose of accommodating a retaining wedge such as retaining wedge 18 of FIG. 1*b*. FIG. 1*b* illustrates a top view of conventional hammer head 15 and head to handle interface 19 of FIG. 1*a*, which also clearly illustrates retaining wedge 18, and an upper end portion 12 of head to handle interface 19 inserted up into interface opening 20 of hammer head 15. The conventional manner of securing head to handle interface 19 to hammer head 15 is, after assembling hammer head 15 to the upper end of head to handle interface 19, manually driving retaining wedge 18, the larger rear surface of which is greater than the dimension of slot 13, such that by driving retaining wedge 18 down into upper end portion 13 of handle interface 19, each side portion of interface 19 on either side of slot 13 is urged outward against the inner walls of interface opening 20, thereby securing the hammer head to the head to handle interface.

In other examples of head to handle interfaces, such as is in conventional claw hammers, or other such conventional striking tools as described, a plurality of retaining wedges may be utilized, which may differ in size and dimension, and may also differ in their orientation relative to the length of hammer head 15, when embedded into interface end portion 12. For example, instead of a rectangular shape opening 20, and oval or even round shape may be utilized. That is to say the retaining wedges when embedded into the end portion of the head to handle interface may be oriented perpendicular to the retaining length of hammer head 15. Further, a slot 13 is not necessarily always provided. In some cases the wedge is driven directly into the wood.

Regardless of the number, size and orientation of the embedded retaining wedges in conventional applications, however, the fact remains that they are driven down into the top portion of the head to handle interface through the top opening of the hammer head, the head to handle interface securing point therefore being located in close proximity to where the extreme striking and pulling forces typically incurred during use of such a striking tool are concentrated. Further, because the opening through which the head to handle interface is inserted is a vertical opening extending completely through hammer head 15, having an opening both on the bottom and the top, and the retaining wedges are driven down from the top opening, such as shown in this example, a smooth upper surface of hammer head is very difficult to achieve, and especially difficult to maintain due to the constant forces which affect the security of the interface and the embedded wedges, possibly causing the upper surfaces of the head to handle interface, hammer head and embedded securing wedges to not be flush with each other, thereby creating an uneven upper surface of the hammer head.

During conventional nail pulling utilizing the claw end of the hammer head, damage may occur to the surface of the material from which the nail is being pulled, which is the surface upon which the top surface of hammer head rocks while the claw hammer is inverted and leveraged to remove the nail. Any other non-conventional uses of the hammer head, which would require a smooth top surface, are also prevented due to the configuration.

FIGS. 2*a* and 2*b* illustrate a claw hammer 21 according to an embodiment of the present invention. Claw hammer 21 has significantly greater head to handle interface integrity and versatility in claw use compared to conventional claw hammer configurations previously described herein. Claw hammer 21 comprises several elements common to conventional claw hammers such as an impact head 24 which provides the striking surface, extended claw portion 26 for use in pulling nails or ripping apart material in a conventional manner, a hammer handle 42 and a head to handle interface 39 for attaching hammer head 44 to hammer handle 42. Claw hammer 21, however, is a departure from conventional art, providing many advantages over conventional claw hammers which overcome several problems in the prior art as described above in the background section.

Hammer head 44 comprises a body portion 43 having an internal cavity 45 adapted to receive the upper portion of handle 42, providing head to handle interface 39. Structural webbing areas 27, 33 and 37, and cross braces 29 are also provided for hammer head 44, providing added structural integrity to hammer head 44 while maintaining a relatively light weight. These features, however, are incidental, and the shape and structure of the head, independent of the openings for the handle interface and the means of securing the head to the handle, may take many forms.

Center web area 37 is defined by cross braces 29 in this example, and is a recessed area, as are structural webbing areas 27 and 33, accommodating an optional side nail pulling slot 22 positioned on the axis of the handle interface. Side nail pulling slot 22 is provided, enabling the user to pull nails which are adjacent to, or in close proximity to obstructions or other protrusions which would otherwise prevent the user from pulling the nail utilizing claw 26 in the conventional manner.

Yet another significant departure from the prior art is the manner in which hammer head 44 is attached to hammer handle 42. Hammer head 44 comprises a body portion 43 having an internal cavity 45 adapted to receive the upper portion of handle 42, which is head to handle interface 39. The inside shape and size of the bottom opening of cavity 45, into which the interface portion of handle 42 is inserted, is substantially equal to the outside shape and size of the interface portion of handle 42, and cavity 45 extends upward into body portion 43, tapering somewhat outward as it extends up into body portion 43, in this example approximately half the distance of the overall height of hammer head 44.

Head to handle interface 39 of handle 42 is provided with a slot 41 which has been cut into the center of handle 42, and extends down handle 42 to a distance approximately half the overall height of hammer head 44. A substantially rectangular wedge opening is provided in body portion 43 of hammer head 44 which accommodates insertion of a retaining wedge 28, for the purpose of securing hammer head 44 to hammer handle 42, via head to handle interface 39. It is known to the inventor that a prefabricated slot is not necessary to practice the invention and that the wedge could be inserted directly into the grain of a wooden handle thereby splitting the handle along the grain.

In practice, hammer head 44 is assembled to hammer handle 42 with head to handle interface 39 inserted up into cavity portion 43 of hammer head 44 as far as it will go, and retaining wedge 28 is then inserted through wedge opening 23 of body portion 43, and forcefully urged into slot 41 of the handle interface 39, thereby spreading each portion of head to handle interface outward urging each portion against the inner walls of cavity 45, thereby securing hammer head 44 to handle 42.

In the present embodiment a pair of ridges 30 are provided for retaining wedge 28, one ridge extending vertically and centered on each side of retaining wedge 28. A pair of grooves 31 are provided on the inner surface of each split portion of head to handle interface 39, corresponding in dimension and location to ridges 30 of retaining wedge 28 when retaining wedge 28 is fully inserted and embedded into slot 41 of head to handle interface 39. When retaining wedge 28 is fully inserted and embedded into slot 41, ridges 30 of retaining wedge 28 secure retaining wedge 28 into slot 41 by virtue of the matching grooves 31 of slot 41. In other embodiments retaining wedge 28 may comprise a pair of grooves instead of ridges, and the matching ridges may be formed on the inner surface of head to handle interface 39 formed by slot 41.

FIG. 2*b* is a top view of hammer head 44 and head to handle interface 39 of FIG. 2*a*. The smooth upper surface of hammer head 44 is shown in this view, showing impact head 24 on one end, and chamfered claw end 26 extending opposite impact head 24. Side nail pulling slot 27 is also clearly visible in this view, centered and on one edge of hammer head 44. Hammer head 44 is shown assembled to head to handle interface upper ends 47 and retaining wedge 28 is shown fully embedded between interface ends 47, which force each of interface ends 47 outward against the inner walls of cavity 45, thereby securing hammer head 44 to the hammer handle. Retaining wedge 28 is secured in the embedded position when ridges 30 snap into the matching grooves 31 of the head to handle interface.

In some embodiments horizontal ridges or groves may be provided in cavity 45, so that urging the wooden ends 47 against the inside walls of the cavity creates an interference fit more securely joining the handle and the head.

It will be clear to the skilled artisan that the shape and structure of head 44 may vary considerably from that shown in FIGS. 2*a* and 2*b*. For example, the body portion 43 may be much shorter than that shown, extending a lesser distance below the striking portion of the head. In practice the side shape and size of the head may be very much like that of the conventional hammer shown in FIG. 1, for example, with the exception that the cavity or eye for the handle interface would be a socket, rather than extending through the head. The innovative difference being the side opening for the wedge.

In yet another embodiment the opening for inserting a wedge or other expansion device into the body portion may be in the front or back of the body portion, that is, extending in the direction of the striking portion or the claw, instead of on one side or the other, as in FIGS. 2*a* and 2*b*. The essential innovation is the fact that the cavity in the head for receiving the handle end is a closed cavity, not extending through the head; and the spreader, such a wedge or cam, is inserted and urged into the handle in a direction at substantially a right angle to the long axis of the handle.

FIG. 3*a* is a broken elevation view of a hammer head to handle interface and a portion of a hammer handle according to an alternative embodiment of the present invention. In this example, slightly enlarged to show greater detail, a body portion 53 is assembled to a head to handle interface 57 of hammer handle 61. Body portion 53, as with that of hammer head 44 of FIG. 2*a* has a similar internal cavity 55, which is similar to that of hammer head 44 of FIG. 2*a* in that the bottom opening is roughly the dimension of hammer handle 61, and the side walls of cavity 55 taper slightly outward as cavity 55 extends up into body portion 53. Cavity 55 is also provided with an arrangement of gripping apertures 59 which line the inner walls of cavity 55. Gripping apertures 59 greatly enhance the security and integrity of the head to handle interface once assembled and secured.

Head to handle interface portion 57 of handle 61 is also provided with a slot 63 which is similar to slot 41 of hammer head 44 of FIG. 2*a*, with the exception that an oval-shaped cutout 65 is bored or otherwise formed in the center of interface 57, forming an oval-shaped opening between the two portions formed by slot 63. A unique cam device 69 is provided in the present embodiment for securing the head to handle interface. Cam device 69 comprises a slotted head portion 70, and an oval-shaped body portion 73, which has an opening 71 bored into its center, extending substantially into, but not completely through body portion 73. Opening 71 is provided for securely positioning cam devise 69 in between the two portions of interface 57, utilizing an axle shaft 67, which extends outward from the inner wall of cavity 55 to a distance approximately equaling that of the depth of opening 71 of cam device 69, and an outside diameter roughly equal to the inside diameter of opening 71.

In practice of the present invention for securing the head to handle interface, head to handle interface portion 57 of handle 61 is inserted up into cavity 55 to a distance limited by the upper wall of cavity 55, similarly to that described for head to handle interface 39 of FIG. 2*a*. Once body 53 is assembled to head to handle interface 57, cam device 69 is inserted through a round opening 72, which has approximately the same circumference as the round slotted head portion of cam device 69. Cam device 69 is inserted over axle shaft 67 of body 53, such that the oval shape of cam devise body 73 coincides with the vertical oval shape of cut out 65 of head to handle interface 57, and the outer surface of round slotted head portion 70 of cam device 69 is flush with the outer surface of body 53.

FIG. 3*b* is a broken elevation view of hammer head to handle interface and handle portion of FIG. 3*a*, illustrated in the secured position. In this illustration, body portion 53 is assembled to head to handle interface 57, and cam device 69 is inserted through round opening 72 of body 53, and positioned over axle shaft 67 of body 53 such that cam device 69 may be rotated within the oval cut-out of head to handle interface 57.

Once cam device 69 is fully inserted over axle shaft 67, cam device 69 is rotated 90 degrees such that the extended portions, that is, the long axis of the oval, of the oval body portion of cam device 69 are horizontal, instead of vertical as in the relaxed position, thereby urging the two portions of head to handle interface 57 outward as indicated, and forcing the outer surfaces of the head to handle interface portions into the arrangement of gripping apertures 59 lining the inner walls of cavity 55, thereby securing the head to handle interface.

In alternative embodiments cam device 69 may be provided with ridges extending longitudinally along cam body 73 and positioned on the extending portions of the oval shaped cam device body 73, and a set of matching grooves cut into oval cut out 65, such that when cam device 69 is inserted and rotated 90 degrees within oval cut out 65, cam device 69 is secured within oval cut out 65 by virtue of the ridges and matching grooves. As described for FIGS. 2*a* and 2*b*, cam device 69 may be provided with grooves instead of ridges, and oval cut out 65 may be provided with matching ridges instead of grooves, or may be provided in other alternative embodiments with an arrangement or combination of protrusions or bumps and indentions to secure the cam device in position once secured within cut out 65. Cam device 69 may also be provided with a variety of well-known means for rotating cam device 69 instead of utilizing a slotted head portion as shown in the illustration, such as utilizing a Philips head slot, a hex indention and so on, without departing from the scope and spirit of the invention.

FIG. 4*a* is a broken elevation view of a hammer head to handle interface and handle portion according to yet another alternative embodiment of the present invention. A head to handle interface in this embodiment comprises some elements of FIGS. 3*a* and 3*b*, including body portion 53 of a hammer head, having an internal cavity 55 the inner walls of which are lined with gripping apertures 59, an axle shaft 67 extending outward from one inner wall of body 53.

In this embodiment however, an alternative cam device 85 is utilized, which is inserted through an opening provided in body 53 between two portions of an interface portion 86, and an alternatively shaped opening is bored into interface 86 between two portions formed by slot 87. Cam device 85 differs from cam device 69 of FIG. 3*a* in that, instead of utilizing an oval shape, cam device 85 comprises a pair of protrusions 89, each having an outward curvature on one side and inward curvature on the other.

In practice of the invention in this example, once body 53 and head to handle interface 86 are assembled together, cam device 85 is inserted through an opening provided in body 53, and over axle shaft 67 similarly to the arrangement for cam device 69 of FIG. 3*a*, such that protrusions 89 are vertical allowing cam device 85 to be fully inserted into slot 87. Cam device 85 is then rotated clockwise 90 degrees within cutout 83 thereby forcing the split portions of interface 86 outward, and urging the outer surface of the split portions into gripping apertures 59 of cavity 55 of body 53. Once rotated 90 degrees, cam device 85 is held in the horizontal position by virtue of the tips of protrusions 89 which fit neatly into the indentions formed in cutout 83 as shown in FIG. 4*b*. In this arrangement, if the user wishes to disassemble body 53 from head to handle interface portion 86, cam device 85 may again be rotated 90 degrees clockwise such that protrusions 89 are again vertical instead of horizontal, allowing removal of cam device 85 from within cutout 83. Such an arrangement may be useful for the purpose of exchanging hammer heads of different weights or types, utilizing a single hammer handle.

The present invention in embodiments presented and in alternative embodiments provides an improved method and apparatus for securing the head of a striking tool to its handle which provides both a durable and secure interface which is substantially less susceptible to the extreme striking and pulling forces, having a securing portion of the interface which extends along a greater portion of the interface as compared to conventional interfaces. The securing point is also located further down the handle interface portion from the upper head portion of the striking tool. By relocating the interface securing point from the upper-most portion of the handle interface, to a point lower along the handle interface, the manufacturer is able to design a completely smooth upper surface of the head portion of the striking tool, such that when using the striking tool for removing nails in the conventional or non-conventional manner as will be disclosed, the possibility of damage being caused to the material along which the top surface of the head portion rocks during pulling of a nail, is substantially minimized. The user is further enabled, utilizing a single hand-held striking tool such as a claw hammer, to not only provide the striking force for driving nails and an improved ability for ripping apart materials, and conventional capability for removing nails utilizing an extended claw end, but also the ability to remove nails from wood or other building materials wherein the nail to be removed is adjacent to, or closely located to an obstruction such as a wall stud, for example. Such non-conventional nail pulling capability is enabled by a smooth upper surface of the head portion by virtue of relocating the handle to head interface securing point lower along the interface portion, and the non-conventional location of a nail pulling apparatus along the upper smooth surface of the head portion.

It will be apparent to one of ordinary skill in the art that many variations may exist in alternative embodiments. For example, retaining wedges or retaining cam devices may differ in shape and style, gripping apertures within the cavity of the body portion may or may not exist and many other such variations may exist without the from the scope and spirit of the invention. For these reasons the invention should be afforded the broadest possible scope, limited only by the following claims.

What is claimed is:

1. A striking tool comprising a head assembled to a handle having a long axis, characterized in that the head comprises a closed cavity extending into the head in the direction of the long axis, an opening through a wall of the head into the cavity, the opening extending at substantially a right angle to the long axis, and a spreading element inserted through the opening and spreading a portion of the handle within the cavity to urge against walls of the cavity to secure the head to the handle.

2. The striking tool of claim 1 wherein the striking tool has a plane of substantial symmetry, and the opening for the spreading element extends in a direction substantially at a right angle to the long axis and substantially at a right angle to the plane of substantial symmetry.

3. The striking tool of claim 1 wherein the striking tool has an axis of substantial symmetry, and the opening for the spreading element extends in a direction substantially at a right angle to the long axis and in the plane of substantial symmetry.

4. The striking tool of claim 1 wherein the spreading element comprises a tapered wedge.

5. The striking tool of claim 1 wherein the portion of the handle extending into the cavity in the head comprises a slot positioned to receive the spreading element, such that the spreading element enters the slot urging parts of the handle on opposite sides of the slot apart and against the walls of the cavity.

6. The striking tool of claim 1 wherein the spreading element comprises a rotatable cam.

7. The striking toot of claim 6 wherein the portion of the handle extending into the cavity in the head comprises a slot and a cam opening to receive the rotatable cam, the cam opening positioned to receive the cam, such that as the rotatable cam is rotated the parts of the handle on opposite sides of the slot are urged apart and against the walls of the cavity.

* * * * *